US006422777B1

(12) United States Patent
Landrau et al.

(10) Patent No.: US 6,422,777 B1
(45) Date of Patent: Jul. 23, 2002

(54) PROTECTIVE COATING UNDERWATER APPLICATOR

(75) Inventors: Nelson Landrau, Marlborough; Leslie Rubin, Newton; Nese Orbey, Acton; William Slager, Somerville; Robert Kovar, Wrentham; Elizabeth Yost, Waltham, all of MA (US)

(73) Assignee: Foster-Miller, Inc., Waltham, MA (US)

( * ) Notice: Subject to any disclaimer, the term of this patent is extended or adjusted under 35 U.S.C. 154(b) by 0 days.

(21) Appl. No.: 09/645,643

(22) Filed: Aug. 24, 2000

(51) Int. Cl.[7] ..... B05C 11/00
(52) U.S. Cl. ..... 401/266; 401/265; 222/566
(58) Field of Search ..... 401/266, 265, 401/263, 261, 5, 14, 9, 193, 264, 27, 25, 16; 222/135, 145.1, 145.5, 566

(56) References Cited

U.S. PATENT DOCUMENTS 1,038,180 A * 9/1912 Moreland ..... 401/266
2,104,086 A * 1/1938 Lines ..... 401/5
3,226,761 A * 1/1966 Adamsky ..... 401/266
3,319,283 A * 5/1967 Delligatti ..... 401/5
4,079,694 A * 3/1978 Galinou ..... 118/201
4,201,491 A * 5/1980 Kohler ..... 401/264
4,241,852 A * 12/1980 Klem ..... 222/103
4,594,015 A * 6/1986 Pomares ..... 401/266
5,902,060 A * 5/1999 Rodriguez ..... 401/266

* cited by examiner

*Primary Examiner*—David J. Walczak
(74) *Attorney, Agent, or Firm*—Iandiorio & Teska

(57) ABSTRACT

A protective coating, underwater applicator including a housing for receiving an underwater protective coating compound; a nozzle on a distal end of the housing having an end opening for applying the protective coating; a spatula extending from one portion of the end opening for spreading the protective coating; and a seal disposed about a substantial portion of the end opening for preventing the loss or coagulation of the protective coating.

12 Claims, 6 Drawing Sheets

PROTECTIVE COATING UNDERWATER APPLICATOR

GOVERNMENT RIGHTS

This invention was made with U.S. Government support under Contract No. N00167-99-M-0465 awarded by The U.S. Navy. The Government may have certain rights in the subject invention.

FIELD OF THE INVENTION

This invention relates to an applicator useful in the application of protective coatings and sealants to ship hulls and other structures under water.

BACKGROUND OF THE INVENTION

The application of protective coatings to ship hulls, and/or crack repair compounds for repairing cracks therein can be accomplished by dry docking the ship but this is an expensive practice not always practical with large ships and also a practice which cannot be employed in the repair or maintenance of other underwater structures such as oil drilling platforms, pipes, bridges and dams.

So, in many cases, divers apply the protective coating under water. This latter methodology, wherein the divers use a brush or a trowel and a separate container of the protective coating compound is problematic since the protective coating often disintegrates and breaks away from the application tool resulting in a loss of product, decreased transfer efficiency, and contamination of the water affecting diver visibility and the release of toxic materials into the water which can harm the diver and marine life.

The practice of using a brush or a trowel and a separate container of the protective coating or sealing compound also makes it very difficult to apply a neat thin film of the coating material under water.

BRIEF SUMMARY OF THE INVENTION

It is therefore an object of this invention to provide an applicator for applying protective coatings, crack repair compounds, and other compounds to structures under water such as ship hulls, oil drilling platforms, pipes, bridges and dams.

It is a further object of this invention to provide such an applicator which eliminates the expense and impracticality of dry docking a ship.

It is a further object of this invention to provide such an applicator which prevents the disintegration and/or coagulation of the coating compound during application.

It is a further object of this invention to provide such an applicator which increases the transfer efficiency of applying a protective coating to an underwater structure and reduces product loss or waste.

It is a further object of this invention to provide such an applicator which reduces contamination of the water which would otherwise affect a diver's visibility and result in the release of toxic materials into the water which could harm the diver and marine life.

This invention results from the realization that the difficulty, inexactness, and the other problems (such as loss of coating material and contamination of the water) associated with prior art methods of applying a protective coating underwater to, for example, the hull of a ship, can be overcome with a special syringe or pressurized type applicator with a nozzle end opening which incorporates a leading wiper and an edge seal for preventing loss and/or coagulation of the protective coating material, and also by an integrated spatula which finally spreads and smooths the protective coating and which also simultaneously applies pressure to better adhere the protective coating. The combination of the syringe and the nozzle provides a controlled volumetric release of the coating material.

This invention features a protective coating, underwater applicator including a housing for receiving an underwater protective coating compound; a nozzle on a distal end of the housing with an end opening for applying the protective coating; a spatula extending from one portion of the end opening for spreading the protective coating; and a seal disposed about a substantial portion of the end opening for preventing the loss or coagulation of the protective coating.

The spatula or blade is typically rigid, smooth, and has a sharp edge and the seal extends over the edges of the blade. In one embodiment, the end opening is elongated (i.e., rectangular), the blade extends from one lengthy side of the opening, and the wiper extends along the opposite side. Edge seals are disposed on the edges of the opening.

In the preferred embodiment, a pivotable joint connects the nozzle with the housing. The seal is preferably made of an elastomeric material which does not react with the protective coating compound. In one embodiment, the housing includes two chambers, one chamber for resin and one chamber for a curing agent. In either embodiment, a plunger, receivable in the housing, urges the protective coating out through the nozzle.

BRIEF DESCRIPTION OF THE DRAWINGS

Other objects, features and advantages will occur to those skilled in the art from the following description of a preferred embodiment and the accompanying drawings, in which.

PREFERRED EMBODIMENT

Figure 1:
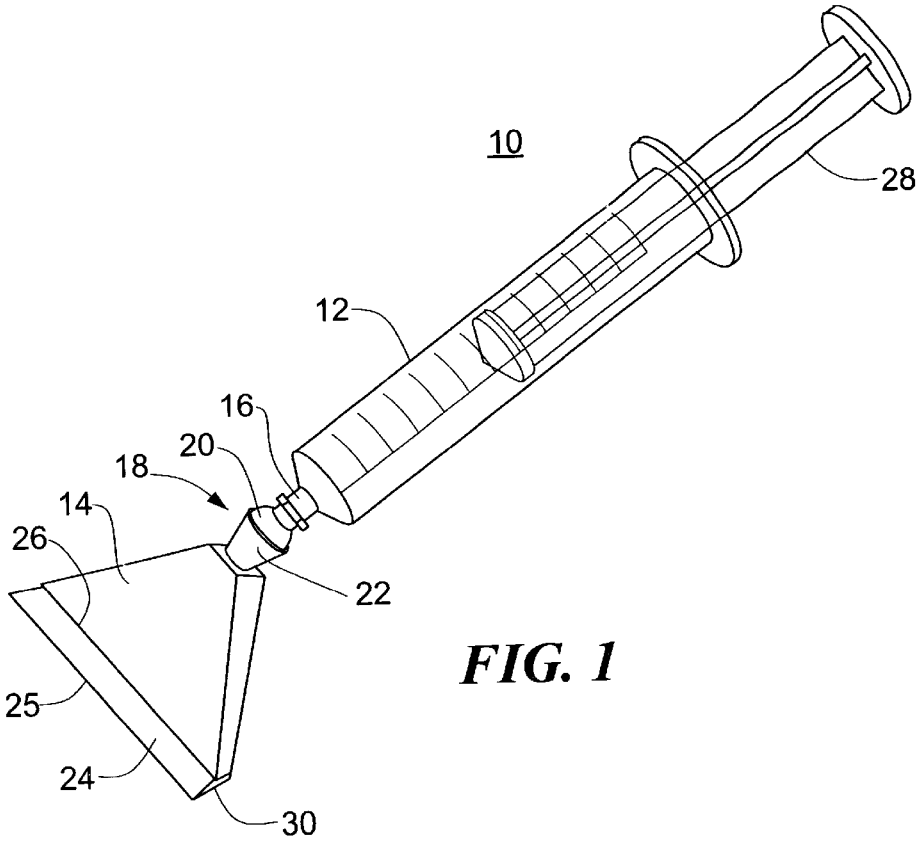
FIG. 1 is a diagrammatic three-dimensional view of the protective coating underwater applicator of the subject invention.

Protective coating underwater applicator 10, FIG. 1, of this invention includes housing 12 which, in one embodiment, is a plastic 60 cc syringe tube which receives a protective coating compound to be applied to an underwater surface such as a ship hull. Nozzle 14 is connected to the distal end 16 of housing 12 by pivotable joint 18 which includes ball 20 pivotably and frictionally secured in socket 22. Spatula 24 (e.g., an aluminum blade) extends from the top end 26 of nozzle 14 and functions to spread the protective coating once it is urged through the end opening of nozzle 14 by the action of plunger 28. Edge 25 of spatula 24 is typically fairly thin and sharp.

Figure 2:
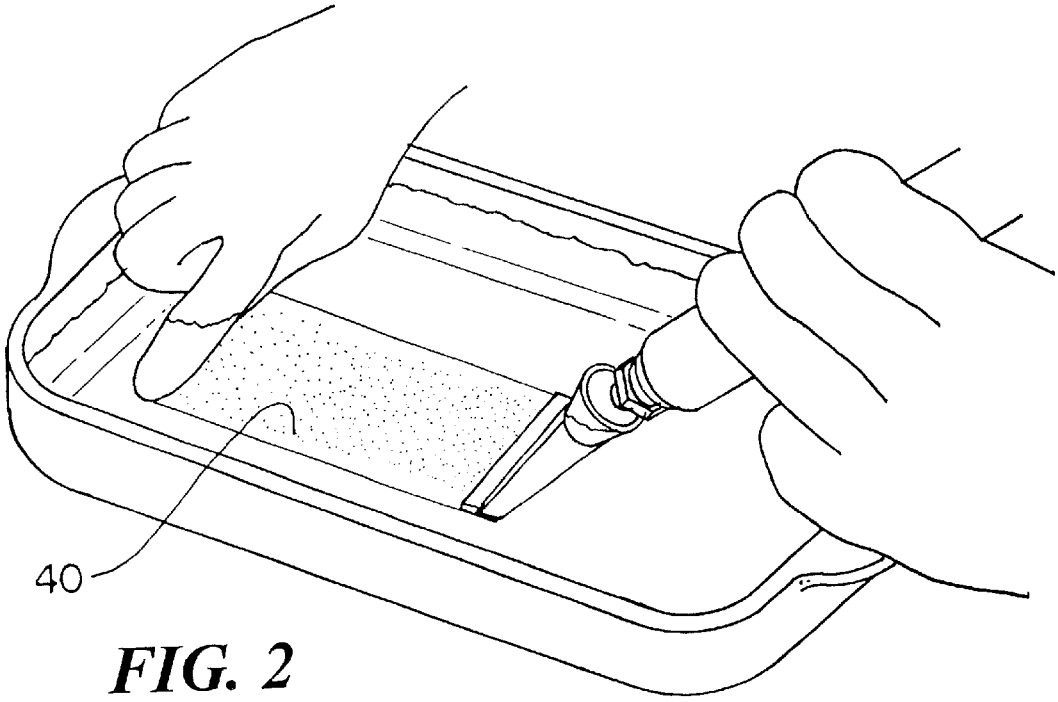
FIG. 2 is a diagrammatic three-dimensional view showing the use of the applicator shown in FIG. 1 as a fine, thin layer of coating material is applied to a surface under water.

Seal 30 is disposed about most of the end opening of nozzle 14 to prevent water from adversely affecting or coagulating the protective coating as it is applied to a surface 40 under water as shown in FIG. 2. Seal 30 also prevents any disintegration, coagulation, and/or loss of the protective coating material and also prevents contamination of the water as the material is applied to a surface under water.

Figure 3:
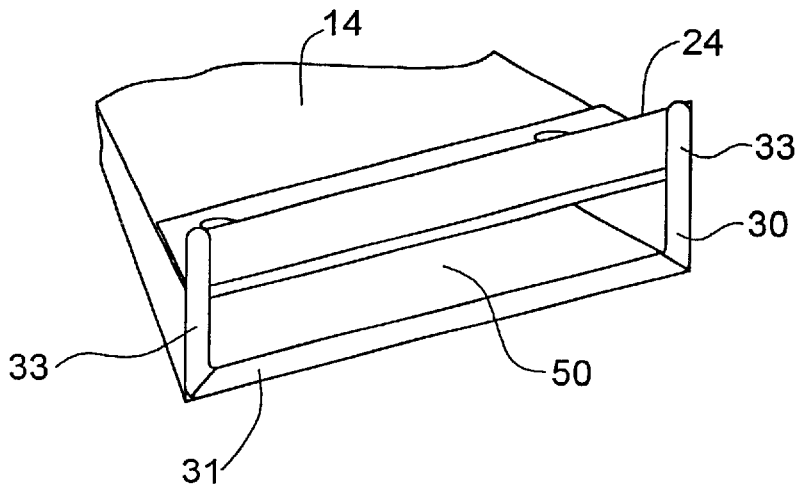
FIG. 3 is a diagrammatic three-dimensional view of an enlarged portion of the nozzle end opening of the applicator shown in FIG. 1.
Figure 4:
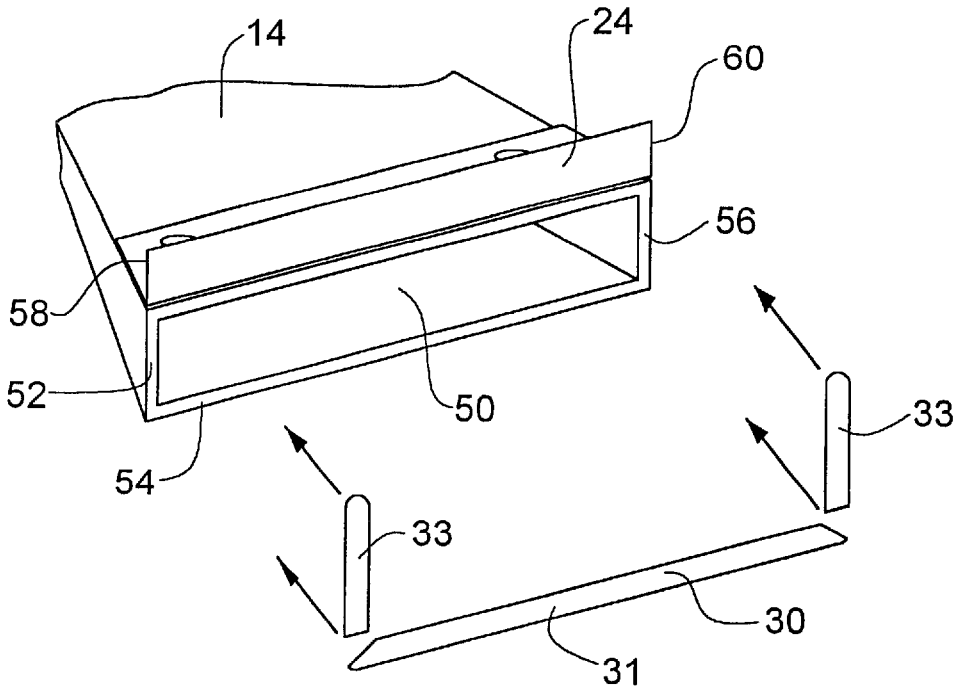
FIG. 4 is a view similar to FIG. 3 with the sealing member removed.

End opening 50 of nozzle 14, FIGS. 3–4 is typically rectangular in shape as shown with a length greatly exceeding its width. Rigid, smooth spatula 24 may be a piece of aluminum bent at an angle and attached to nozzle 14 as shown. Seal 30 is secured by an adhesive to edges 52, 56, and 54 of rectangular opening 50 and the sides of blade 24 as shown in FIG. 4. Bottom wiper portion 31 of seal 30 functions to displace water and is preferably made of an elastomeric material, for example rubber or silicone, which does not react with the protective coating being applied. Side portion 33 of seal 30 is typically made of urethane foam and functions as an edge seal. In the prototype model, two additional pieces of rubber (not shown) were secured to the sides 58 and 60 of blade 24.

Applicator 10, FIGS. 1–2 and nozzle 14, FIGS. 3–4, in accordance with this invention, overcomes the difficulty associated with prior art methods of applying a protective coating under water. Material is not wasted nor does it cloud the water adversely affecting a diver's visibility or pose a threat to marine life because of the combination of wiper 31, edge seals 33, and spatula 24 which displaces any water at the location on a given surface where the protective coating is being laid down. When a hydrophobic coating or sealant is used in connection with applicator 10, this novel combination prevents coagulation of the coating. Integrated spatula 24 also functions to finely spread and smooth the protective coating and allows the simultaneous application of pressure which results in better adhesion of the protective coating to the often rusted, steel hull of a ship.

In one embodiment, the resin and curing agent constituting the protective coating or sealing compound is mixed before filling syringe 12, FIG. 1. Swivel joint 18 allows the diver to adjust the orientation of nozzle 14 with respect to syringe 12 to suit the diver's preference. Seal 30 and spatula 24 "pushes away"sea water just before the application of the compound which makes the application of the compound to a given surface easier and also promotes better adhesion. Device 10 can be discarded after use which makes cleanup easier. Alternatively, device 10 can be cleaned and reused.

Preferred hydrophobic sealing compounds include (a) Shell Epon 828 (51.5% by weight), mixed with Air Product Sur Wet (19.1% by weight), Air Product Ancamine MCA (19.1% by weight) and Air Product Ancamine K54 (10.3% by weight); (b) CIBA GY 6010 (60% by weight) mixed with CIBA EUR 450 (40% by weight); and (c) Philly Seal R, Resin (50% by weight) mixed with ITW Philadelphia Curative (50% by weight). However, other sealing or crack repair compounds, even non-hydrophobic compounds, may also be used in connection with applicator 10.

Figure 5:
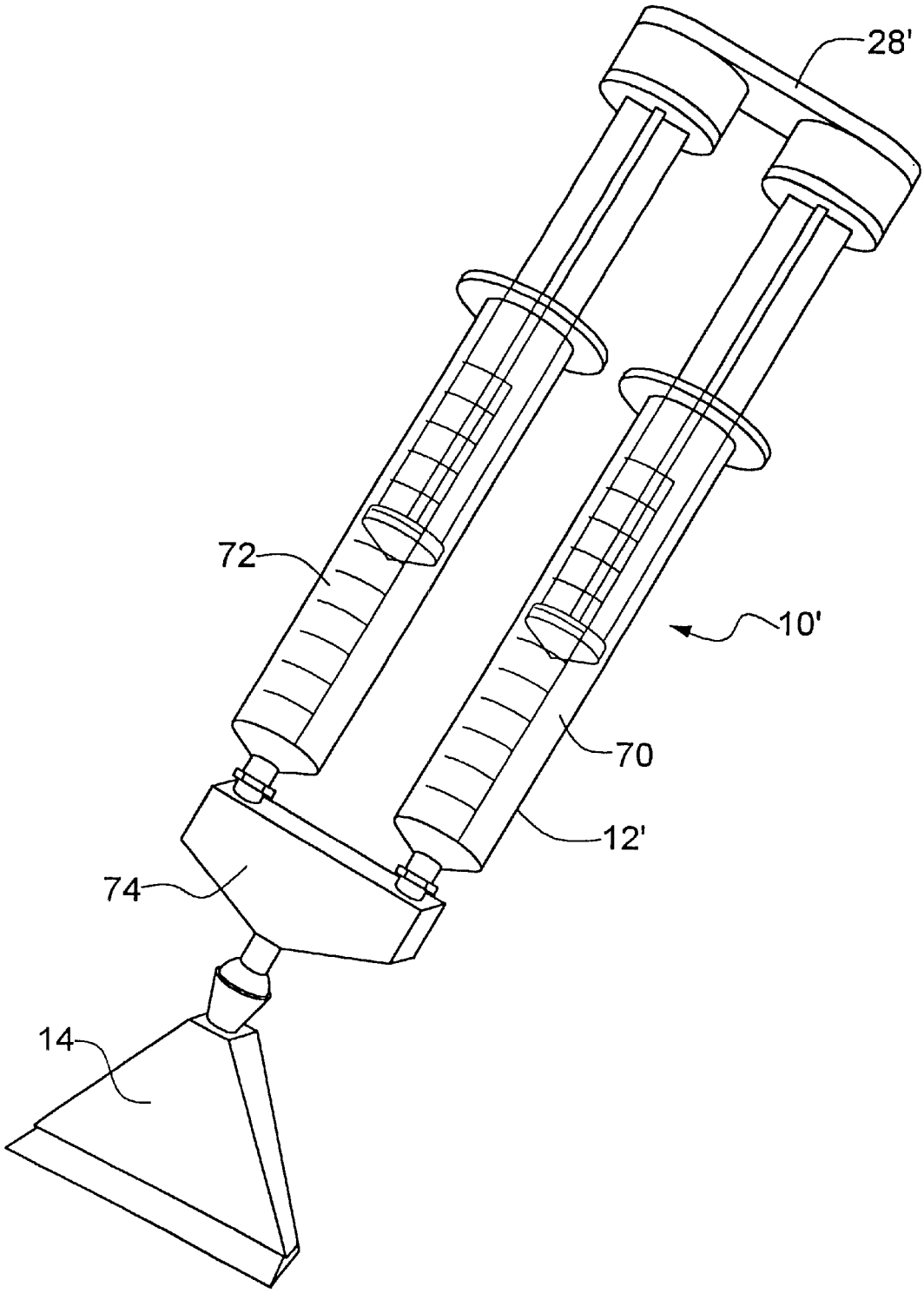
FIG. 5 is a view of another embodiment of a protective coating underwater applicator in accordance with the subject invention with dual syringes.

In the embodiment shown in FIG. 5, housing 12' of device 10' includes two chambers 70 and 72 and additional mixing chamber 74 as shown. Chamber 70 is filled with a resin compound and chamber 72 is filled with a curing agent (or vice versa) and dual plunger assembly 28' urges the curing agent and the resin through mixing chamber 74 and out the end opening of nozzle 14. In other embodiments, a pneumatically driven, trigger operated, gunlike device could be fitted with nozzle 14. By mixing the resin compound and the curing agent in situ, the difficulties associated with pot life are eliminated.

Figure 6:
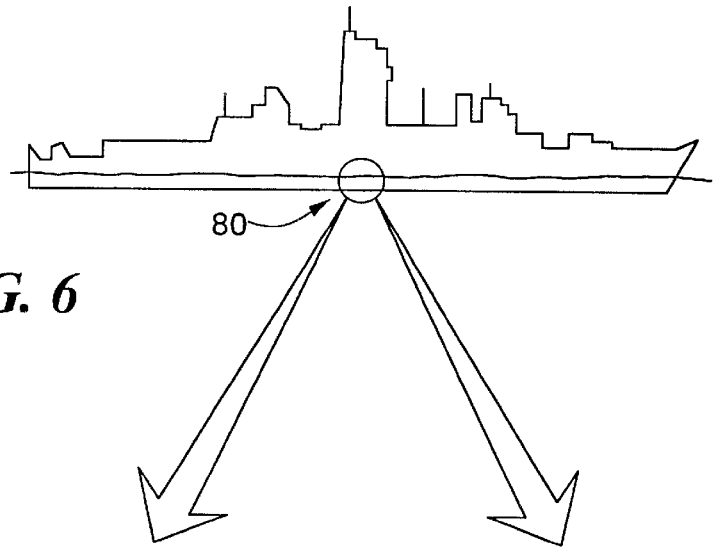
FIG. 6 is a schematic side view of a ship hull which can be coated or repaired using the protective coating underwater applicator of the subject invention.
Figure 7:
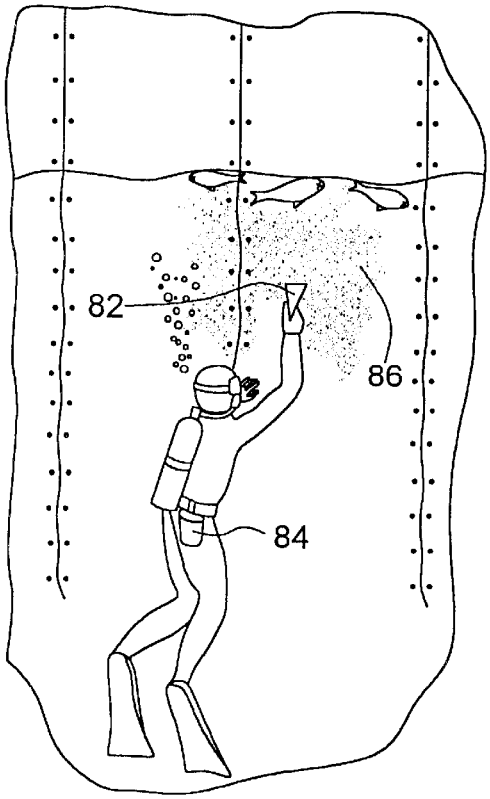
FIG. 7 PRIOR ART
FIG. 7 is an illustrative view showing the clouding and contamination that occurs in accordance with prior art methods of applying a protective coating under water using a trowel and a separate container for the protective coating.
Figure 8:
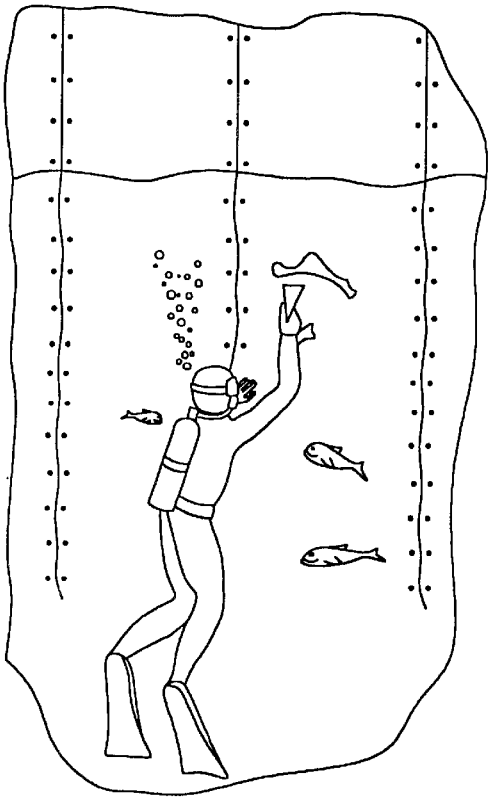
FIG. 8 is an illustrative view showing the use of the protective coating underwater applicator of the subject invention.

In any embodiment, the result is a neat and clean application of the sealing compound to the hull of a ship (or other underwater surface) 80, FIG. 6, as shown in FIG. 8 in contrast to the prior art practice of using a trowel and/or a brush 82, FIG. 7, and separate container 84 which resulted in a vision obscuring and toxic cloud of waste material 86.

Figure 9:
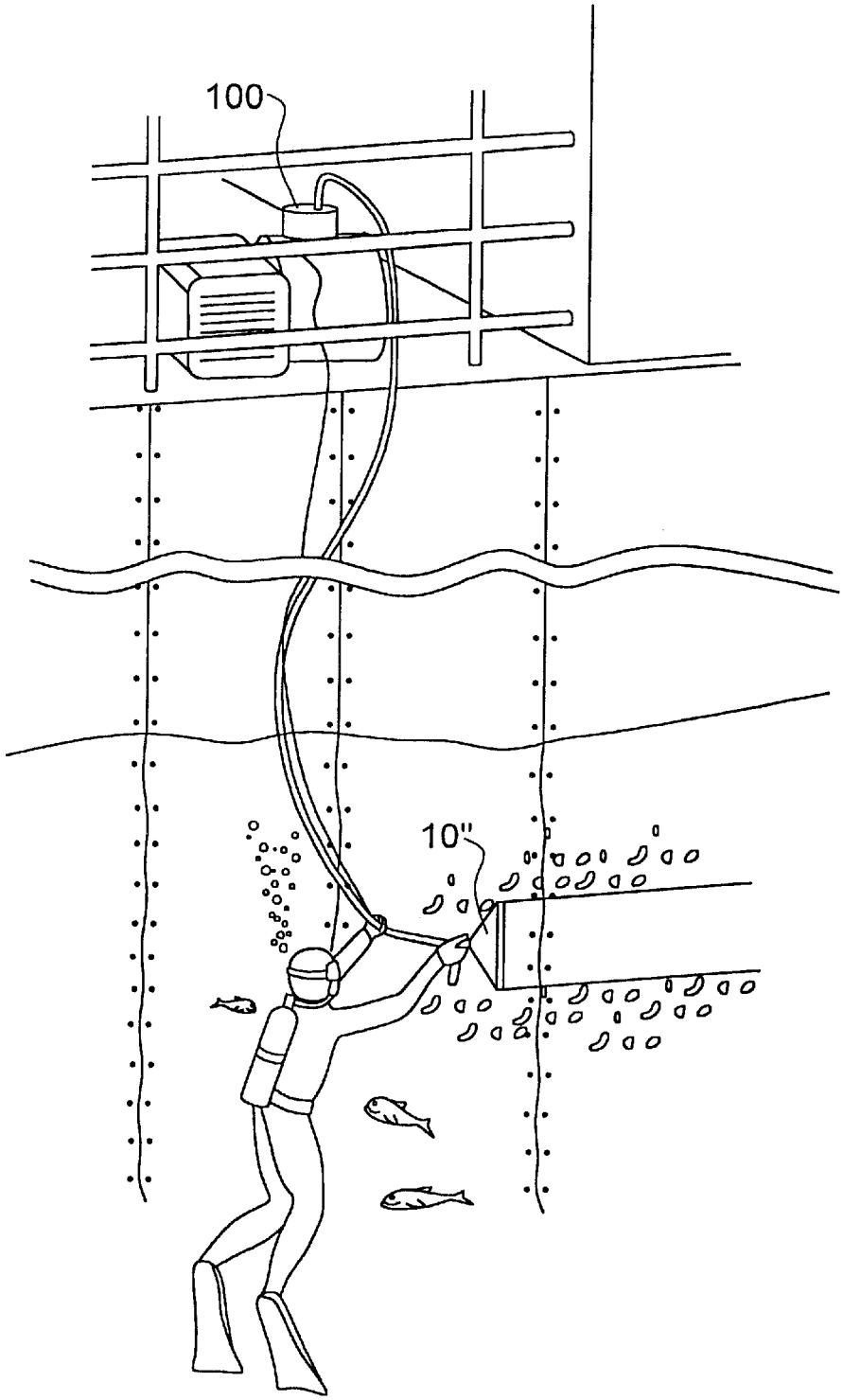
FIG. 9 is an illustrative view of the applicator connected to a source of a protective compound.

In the embodiment shown in FIG. 9, applicator 10" is connected to a source of a protective compound continuously supplied to applicator 10" by pump 100 located on the deck of a ship.

Although specific features of the invention are shown in some drawings and not in others, this is for convenience only as each feature may be combined with any or all of the other features in accordance with the invention.

Other embodiments will occur to those skilled in the art and are within the following claims:

What is claimed is:

1. A protective coating, underwater applicator comprising:

at least one housing for receiving an underwater protective coating compound;

a nozzle on a distal end of the housing including an end opening surrounded by distal edges of the nozzle for applying the protective coating;

a spatula extending from one portion of the end opening for spreading the protective coating as it is applied by nozzle; and a seal disposed on a substantial portion of the distal edges of the nozzle surrounding the end opening for preventing a loss or coagulation of the protective coating.

2. The applicator of claim 1 in which the spatula is rigid, smooth, and has a sharp edge.

3. The applicator of claim 1 in which the seal extends over edges of the spatula.

4. The applicator of claim 1 in which the end opening is elongated, the spatula extends from one side of the opening, and the seal extends around the periphery of the end opening except said one side, and the seal includes a wiper portion opposite the spatula and edge seals on the edges of the opening.

5. The applicator of claim 1 further including a pivotable joint connecting the nozzle with the housing.

6. The applicator claim 1 in which the seal is made of an elastomeric material which does not react with the protective coating compound.

7. The applicator of claim 1 in which the housing includes two chambers, one chamber for resin and one chamber for a curing agent.

8. The applicator of claim 1 further including at least one plunger receivable in the housing for disposing the protective coating out through the nozzle.

9. The applicator of claim 1 in which the seal includes a wiper portion.

10. The applicator of claim 1 in which the seal is formed from a plurality of discrete pieces.

11. A protective, underwater applicator comprising:

at least one housing for receiving an underwater protective coating compound;

a nozzle on the distal end of the housing including an elongated end opening for applying the protective coating;

a spatula extending from one side of the end opening for spreading the protective coating as it is applied by the nozzle; and a seal disposed around the periphery of the end opening except said one side for preventing the loss or coagulation of the protective coating, the seal including a wiper portion opposite the spatula and edge seals on the edges of the opening.

12. A protective coating, underwater applicator comprising:

at least one housing for receiving an underwater protective coating;

a nozzle on a distal end of the housing terminating in an end opening surrounded by distal edges of the nozzle for applying the protective coating;

a spatula extending from one portion of the end opening for spreading the protective coating as it is applied by nozzle; and a seal disposed on a substantial portion of the distal edges of the nozzle surrounding the end opening and engageable with a surface for preventing the loss of coagulation of the protective coating when the nozzle is placed on the surface.

* * * * *